US010682652B2

(12) United States Patent
Yamamoto

(10) Patent No.: US 10,682,652 B2
(45) Date of Patent: Jun. 16, 2020

(54) SYSTEM AND PROCESS FOR DRY RECOVERY OF IRON OXIDE FINES FROM IRON BEARING COMPACTED AND SEMICOMPACTED ROCKS

(71) Applicant: New Steel Global N.V., Amsterdam (NL)

(72) Inventor: Mauro Fumyo Yamamoto, Rio de Janeiro (BR)

(73) Assignee: NEW STEEL GLOBAL N.V., Amsterdam (NL)

( * ) Notice: Subject to any disclaimer, the term of this patent is extended or adjusted under 35 U.S.C. 154(b) by 295 days.

(21) Appl. No.: 15/550,667

(22) PCT Filed: Feb. 5, 2016

(86) PCT No.: PCT/BR2016/050020

§ 371 (c)(1),
(2) Date: Aug. 11, 2017

(87) PCT Pub. No.: WO2016/127235

PCT Pub. Date: Aug. 18, 2016

(65) Prior Publication Data

US 2018/0036803 A1 Feb. 8, 2018

(30) Foreign Application Priority Data

Feb. 13, 2015 (BR) ..... 102015003408

(51) Int. Cl.
*B02C 23/38* (2006.01)
*B03B 7/00* (2006.01)
(Continued)

(52) U.S. Cl.
CPC ..... *B02C 23/38* (2013.01); *B02C 23/14* (2013.01); *B03B 7/00* (2013.01); *B03B 9/00* (2013.01);
(Continued)

(58) Field of Classification Search
CPC ..... B02C 23/14; B02C 23/38
(Continued)

(56) References Cited

U.S. PATENT DOCUMENTS 3,905,556 A * 9/1975 Drage ..... B02C 23/14 241/19
4,145,007 A * 3/1979 Jetzer ..... B03B 9/061 241/19

(Continued)

FOREIGN PATENT DOCUMENTS

BR 102012008340 A2 10/2013
WO WO 2014/063211 A1 5/2014

*Primary Examiner* — Faye Francis
(74) *Attorney, Agent, or Firm* — Alston & Bird LLP

(57) ABSTRACT

A system and a process for dry recovery of iron oxide fines from iron hearing compact and semicompact rocks are provided, which system and process utilize primary, secondary and tertiary crushing components for preliminarily reducing the granulometry of ores containing the iron oxide fines in compact and semicompact rocks. Dynamic air classifier components are provided for finely grinding iron oxide minerals reduced through primary, secondary and tertiary crushing, along with static air classification components arranged in series for intermediate granulometric cuts and bag filters for retaining fine fraction. The system and process further comprise magnetic rolls, for magnetic separation, arranged in cascade at a variable leaning angle and formed by at least one of high or low magnetic intensity magnets.

18 Claims, 15 Drawing Sheets

(51) Int. Cl.

| | |
|---|---|
| ***B03B 9/00*** | (2006.01) |
| ***B03C 1/10*** | (2006.01) |
| ***B03C 1/30*** | (2006.01) |
| ***C22B 1/00*** | (2006.01) |
| ***B02C 23/14*** | (2006.01) |
| ***B03C 1/025*** | (2006.01) |
| ***B07B 11/06*** | (2006.01) |
| ***B22F 9/04*** | (2006.01) |
| ***C22B 1/24*** | (2006.01) |
| *B03C 1/033* | (2006.01) |
| *B03C 1/16* | (2006.01) |

(52) U.S. Cl.
CPC ..... *B03C 1/025* (2013.01); *B03C 1/10* (2013.01); *B03C 1/30* (2013.01); *B07B 11/06* (2013.01); *B22F 9/04* (2013.01); *C22B 1/00* (2013.01); *C22B 1/24* (2013.01); *B03C 1/0332* (2013.01); *B03C 1/16* (2013.01); *B03C 2201/20* (2013.01); *C21B 2200/00* (2013.01)

(58) Field of Classification Search
USPC ..... 241/152.2
See application file for complete search history.

(56) References Cited

U.S. PATENT DOCUMENTS

| | | | | |
|---|---|---|---|---|
| 5,772,126 | A * | 6/1998 | Hanvey, Jr. ..... | B03B 9/062 241/152.2 |
| 5,992,774 | A * | 11/1999 | Oh ..... | B03B 9/065 209/12.1 |
| 8,567,702 | B2 * | 10/2013 | Kulesa ..... | B29B 17/0026 241/19 |
| 9,440,239 | B1 * | 9/2016 | Horton ..... | B03B 9/065 |
| 2009/0041639 | A1 * | 2/2009 | Vanderpool ..... | B09B 3/00 422/184.1 |
| 2014/0014748 | A1 * | 1/2014 | Zeeck ..... | C10L 5/44 241/18 |

* cited by examiner

15

SYSTEM AND PROCESS FOR DRY RECOVERY OF IRON OXIDE FINES FROM IRON BEARING COMPACTED AND SEMICOMPACTED ROCKS

CROSS-REFERENCE TO RELATED APPLICATIONS

This application claims the benefit of priority to PCT/BR2016/050020, filed Feb. 5, 2016, which claims priority to Brazilian Patent No. BR 102015003408-3, filed Feb. 13, 2015, the entire contents of which is incorporated herein by reference.

The invention in question relates to a process for dry recovery of iron oxide fines ($Fe_2O_3$ and/or $Fe_3O_4$=FeO.$Fe_2O_3$) present in compact and semicompact rocks of the following type: compact itabirite iron ore, jaspelite iron oxide ore, taconite iron oxide ore and magnetite iron oxide ore. To effect the recovery of said iron oxides ($Fe_2O_3$ and/or $Fe_3O_4$), grinding must be performed till the iron oxide minerals are liberated from the canga. The liberation degree is specific for each type of ore. Grinding granulometry is usually lower than 150 microns and may reach 25-45 microns.

In the context of the present invention, fines are the iron oxide minerals below 150 microns. In the current processes, fines are recovered in the presence of water by conjugating a magnetic separation system with a flotation system (reverse flotation, floating silica and depressing iron ore or direct flotation of iron oxide). In the present invention, said process is performed through dry recovery.

Thus, the invention in question aims at innovating and simplifying the process for recovery of iron oxide fines ($Fe_2O_3$ and/or $Fe_3O_4$) present in said compact and semicompact iron oxide ores, particularly the ones of the following types: compact itabirite iron oxide ores, jaspelite iron oxide ore, taconite iron oxide ore and magnetite iron oxide ore, duly ground during liberation granulometry, so as to provide high metallurgic and mass recovery.

In consequence of the present invention a commercially superior iron oxide concentrate can be obtained by means of a totally-dry process, more precisely recovered from compact itabirite iron oxide ore, jaspelite iron oxide ore, magnetite iron oxide ore which content is above 63% Fe, that, by means of a single adjustment, the final content of the iron concentrate can reach up to 67% Fe.

In fact, a significant advancement in terms of environment protection can also be achieved, mainly because beneficiation (dressing) does not require water, which results in considerable economy of a substance that is becoming increasingly rare. Another relevant consequence of said invention lies in the absence of tailings dams. In respect of that, one just have to bear in mind the shameful history of iron mining dam bursts occurred in Brazil as well as around the world, that caused terrible environmental catastrophes.

Therefore, amongst the innovative features of said process route, besides the above-mentioned benefits, the processing of compact iron ores has a low moisture content, thanks to the fact that compact and sem icompact rocks (such as compact itabirite iron oxide ore, jaspelite iron oxide ore, taconite iron oxide ore and magnetite iron oxide) have a densely closed crystalline structure and, consequently, they prevent their inner portion from absorbing humidity. Such a feature eliminates one of the steps of the process that is the drying, when compared to the process of recovery of iron fines and superfines contained in tailings dams and/or moist process of recovery of compact iron oxide ore fines and superfines, like, for instance, the ones utilized in active mines in the U.S., that exploit taconite iron oxide ore. Thus, the 2-3% residual moisture can be eliminated during the fine grinding process, carried out according to the type of compact iron oxide ore in question.

DESCRIPTION OF THE PRIOR ART

In the conventional routes of compact iron oxide ore dressing, comminution (where the material is fragmented into small particles, normally below 150 micrometers) and concentration are entirely carried out in the presence of water. The initial steps of the process, both in the moist and dry routes, are conducted in the presence of natural humidity. Said steps correspond to primary, secondary and tertiary crushing, according to the type of ore and the beneficiation route as established. Following that, in the moist route, grinding is performed by ball mills and vertical mills comprised of steel balls, always in the presence of water.

In the moist process route, iron balls are utilized as grinding agents in ball mills. Both in ball mills and vertical mills (e.g., Vertimill), granulometric classification, i.e., grinding granulometry control, is performed through classification by hydrocyclones, wherein the vortex and apex parameters are adjusted to a granulometric cut defined in the hydrocycloning process. Thus, the over flow corresponds to a fine fraction ground according to the liberation granulometry, and the under flow corresponds to the thicker fraction, out of the liberation granulometric range, which re-feeds the mill.

Discharge from the ball mill feeds a slurry pump which, in turn, feeds a set of hydrocyclones. Occasionally, depending on the granulometric cut, one or two more reprocessing steps are required both for under flow and over flow. Subsequently, for each of said processing steps, one more slurry pump and one more set of hydrocyclones are required, which results in more water being added, which can render the project even more complex, with a greater volume of use of water.

Besides, "over flow" has a low content of solids, which has to be thickened in order to increase the solid content. Such a process is usually carried out by a thickener. Then, the thickened slurry must be subjected to other processing steps, which can be high intensity magnetic separation and/or low intensity magnetic separation followed by the high intensity one, the magnetic fraction (iron oxide concentrate) further being sent to reverse or direct flotation steps (cleaner step). By reverse flotation we mean having the contaminating element (silica, for example) float. By direct flotation we mean having the iron oxide minerals float. In reprocessing the over flow, a typical 20 μm or 10 μm fraction is disposed, which can be sent to the thickener and then to the tailings dam.

Patent BR 102014025420-0 discloses a process and a system for the dry recovery of iron oxide ore fines and superfines from iron mining tailings dam. However, it was noticed that the solution revealed by said invention does not apply to the dry recovery of iron oxide fines in compact and semicompact iron oxide bearing rocks in compact itabirite iron oxide ore, jaspelite iron oxide ore, taconite iron oxide ore and magnetite iron oxide ore.

OBJECTIVES AND ADVANTAGES OF THE INVENTION

In view of the above-mentioned situation, the invention in question aims at providing a system and a process for dry recovery of iron oxide fines in compact and semicompact iron oxide bearing rocks in compact itabirite iron oxide ore, jaspelite iron oxide ore, taconite iron oxide ore and magnetite iron oxide ore, duly ground during liberation granulometry.

The invention also aims at providing a magnetic separation unit exhibiting satisfactory efficacy when it comes to materials that are traditionally non-processable by magnetic separators by means of permanent high intensity, rare earth magnet rolls (like iron-boron-neodymium) and low intensity ferrite magnets (like iron-boron).

Said objectives are achieved in an absolutely effective way by eliminating the environmental risks during the implementation of the system, by promoting a conscious use of the natural resources, by producing an iron oxide concentrate product, reutilizing mining waste in the civil construction industry, thus saving a lot of water, for the technique in accordance with the invention in question does not require water.

In times of growing environmental demands, the present invention represents a definitive answer to the challenge of generating environmentally sustainable economic results, mainly characterized by:

- Non-use of water in the process of recovery of iron oxide, thereby sparing headwaters and aquifers;
- A more efficient separation to produce a cleaner mining waste;
- Total reutilization of the mining waste by the civil construction industry;
- Improved mass and metal recovery of iron oxide;
- Recovery of iron oxide ore fines in fractions <100 mesh (<0.15 mm) without losses caused by the arrastra;
- Absence of combustion residues;
- Non-existence of atmospheric effluents;
- Logistic optimization with localized treatment;
- Elimination of risks of accidents involving dams;
- Reduction of the physical space where the system is intended to be implemented;
- Low power consumption;
- System modularity and flexibility;
- Increase in the mines' useful life; and
- Functional Independence of mines already in operation.

In the case of the instant invention, the absence of combustion residues and the non-existence of atmospheric effluents are due to the fact that in the compact iron oxide ore dressing, drying is not necessary, and in the combustion process fine powder is not produced either.

In the dry process according to the invention in question, grinding is performed by vertical mills, or pendulum (track) mills, or ball mills, all of them provided with an air-classification system. The presence of a dynamic air classifier aims at performing the granulometric cut in the grid according to the diameter established by the liberation degree, in which diameter can change depending on each type of iron oxide bearing ore.

It will be noticed that low moisture content compact iron oxide ores need to be dried because of their low moisture content, so that the friction between the minerals and grinders during grinding tends to generate the heat required to promote the residual drying of the moisture present in the material.

DETAILED DESCRIPTION OF THE FIRST STEP—CRUSHING

Figure 1:
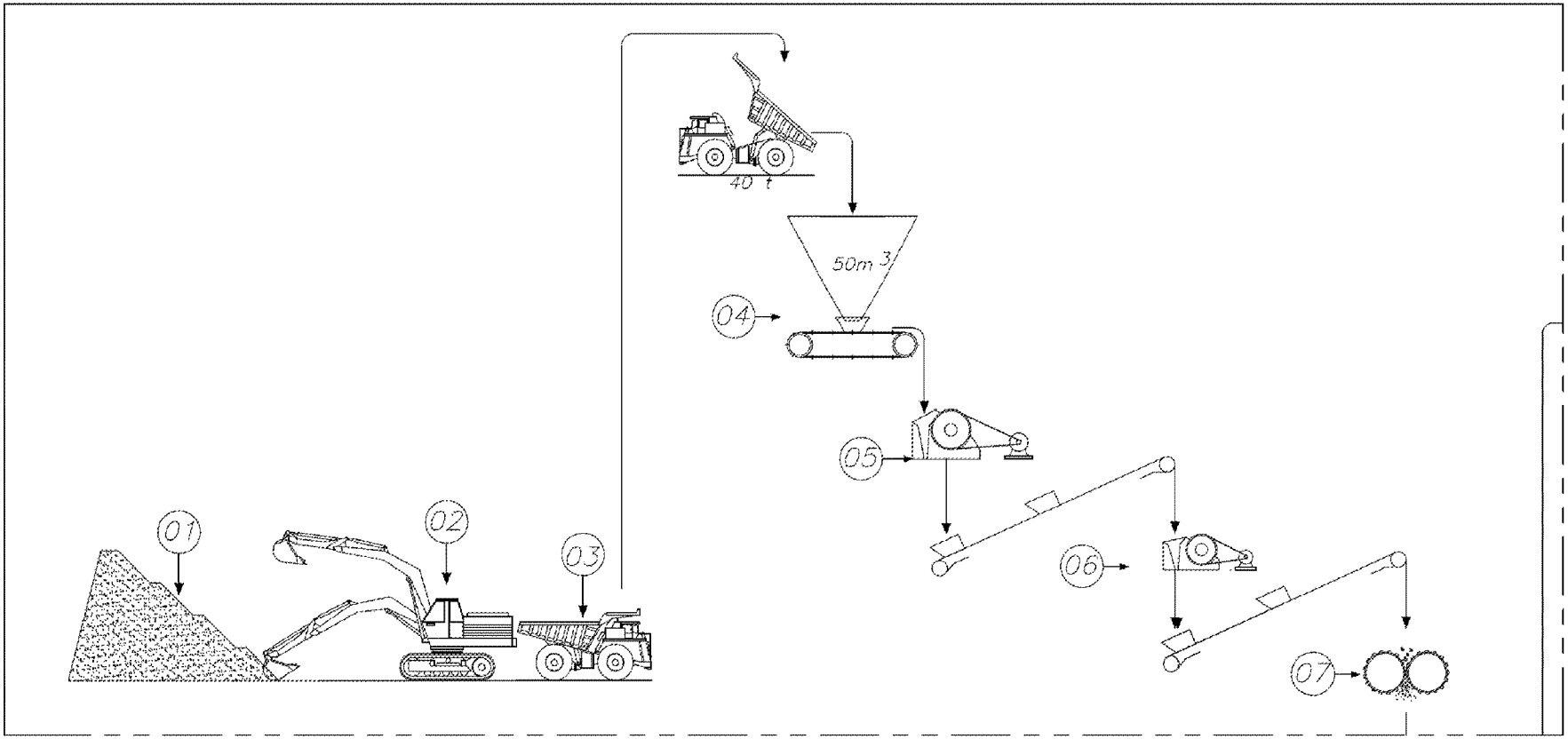
FIG. 1 illustrates exemplary steps of the primary crushing process for iron ore oxide dry beneficiation according to a first option.
Figure 2:
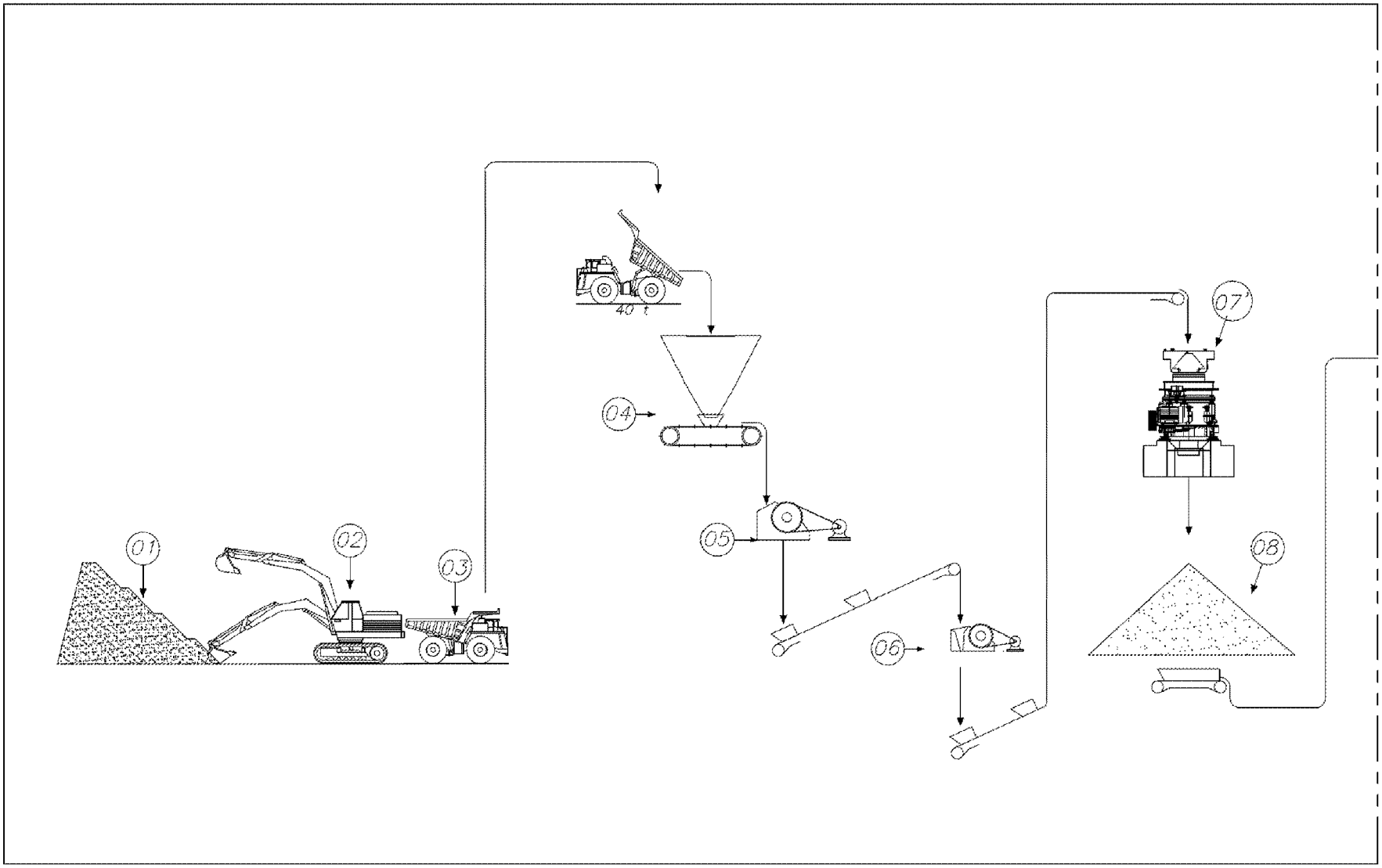
FIG. 2 illustrates exemplary steps of the primary crushing process for iron ore oxide dry beneficiation according to a second option.

Before starting the description of the invention, it should be noted that the magnitudes set forth herein are mere examples and should not be understood as limiting the scope of protection of the present invention. One skilled in the art, faced with the concept disclosed herein, will know how to determine the appropriate magnitudes to the case, in order to achieve the objectives of the present invention. There are presented at least three arrangements and options of primary, secondary and tertiary crushing; the combinations are made between the secondary and tertiary crushing, and the equipment combined is:

- Jaw re-crusher as secondary crushing×HPGR (High Pressure Grinding Roll) as tertiary crushing, shown in FIG. 1
- Jaw re-crusher as secondary crushing×cone crusher as tertiary crusher, shown in FIG. 2.

Said unitary steps of size reduction by crushing are common to all mining processes.

Option 1 for Crushing (FIG. 1)

In FIG. 1, the unitary steps of the primary crushing process for iron ore oxide dry beneficiation are presented with primary crushing in the jaw crusher and the secondary crushing in the jaw re-crusher and tertiary crushing in high pressure grinding rolls (HPGR or similar).

In the extraction of compact ore 1, due to its high resistance as it is a compact rock, break up is made by fire (for example, by means of explosives). Next, the compact ore is removed from mining, for example, by means of a an excavator 2 and placed in the bucket of a truck 3. The bucket truck 3 feeds a silo or hopper 4 with the ore which is then taken to a primary jaw crusher 5, and may be combined with a re-crusher 6 which then feeds a further particle size reduction step in equipment known as HPGR 7 reducing the material to a particle size less than ¼" (6.4 mm), The crusher 5 and the re-crusher 6 provide an initial breaking of the ores into a particle size of +/−75 mm. After jaw crusher 5 and if a recrusher is included, the final particle size is +/−30 mm. Next, after processing in HPGR 7, the particle size is reduced to +/−¼" (6.4 mm) and the material is transferred to a buffer silo. The need or absence of a buffer silo, as well as its capacity is a matter to be decided in the project design.

Option 2 for Crushing (FIG. 2)

In FIG. 2, the unitary steps of the primary crushing process for iron ore oxide dry beneficiation are presented with primary crushing in the jaw crusher and the secondary crushing in the jaw re-crusher and tertiary crushing in a cone crusher.

In the extraction of compact ore 1, due to its high resistance as it is a compact rock, break up is made by fire (for example, by means of explosives). Then, it is removed from mining, for example, by means of a an excavator 2 and placed in the bucket of a truck 3. The truck 3 feeds a silo or hopper 4 with the ore, then the ore is conducted to a primary jaw crusher 5 and then to a secondary re-crusher 6 and the material processed therein goes to another size reduction step, a cone crusher 7' reducing the material to a particle size less than ¼" (6.4 mm), which can be deposited on a buffer pile 8.

Therefore, the first step of the present invention consists of unitary processes of size reduction, by means of a crusher 5, a re-crusher and HPGR or cone crusher, which are known in the art.

The unitary steps following the crushing process are described below, which are grinding, air classification in different particle size ranges and high intensity magnetic separation in each of particle size ranges which, combined with the steps above, provide the effects desired by the present invention.

DETAILED DESCRIPTION OF THE PROCESS FO THE PRESENT INVENTION

The inventive process is further based on the following unitary steps:

The unitary step of fine grinding in the degree of liberation of iron ore×canga, with particle size cut effected by dynamic air classifier.

Static air classification unitary step in which cyclones are arranged in series, in which granulometric cuts are made according to the degree of liberation versus milling, which can be divided into three different particle size ranges. There may be one or two cuts and the decision on the number of granulometric cuts will depend on the degree of liberation, and the super fine fraction of less than 10 or 5 micron may be retained in the bag filters.

Magnetic Separation Sequence, which may be of low-intensity and of high-intensity and/or high-intensity and of high magnetic intensity in each particle size ranges classified by the cyclone process of the static air classification type.

In the unitary step of milling, several types of equipment may be used, according to the present invention, such as:

Vertical mill;

Pendulum mill;

ball mill, duly transformed for dry processing.

Figure 3:
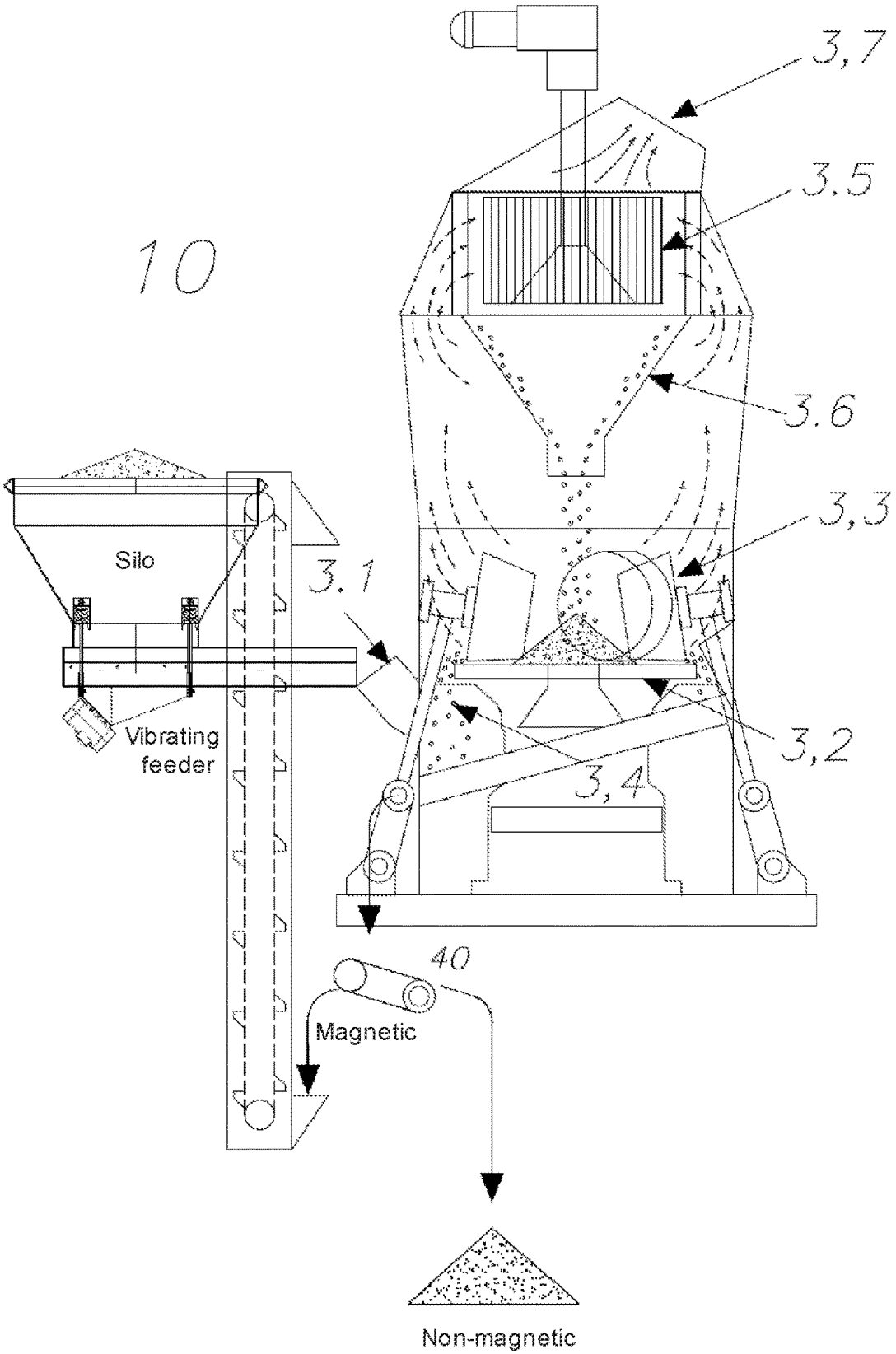
FIG. 3 illustrates the main constituents for milling in a vertical mill according to various embodiments.

Unitary Step of Milling in a Vertical Mill (FIG. 3)

Currently this type of equipment is widely used in the cement industry for clinker grinding to a particle size of less than 45 micrometers. This equipment has shown a superior performance to other existing mills in the cement industry and currently most cement industries adopts this type of mill replacing the previous models. One of the innovations of the present invention is to provide a process route that is the field of cement industry for the primary mining beneficiation of iron oxide from compact and semi-compact rocks in a dry process.

Figure 10:
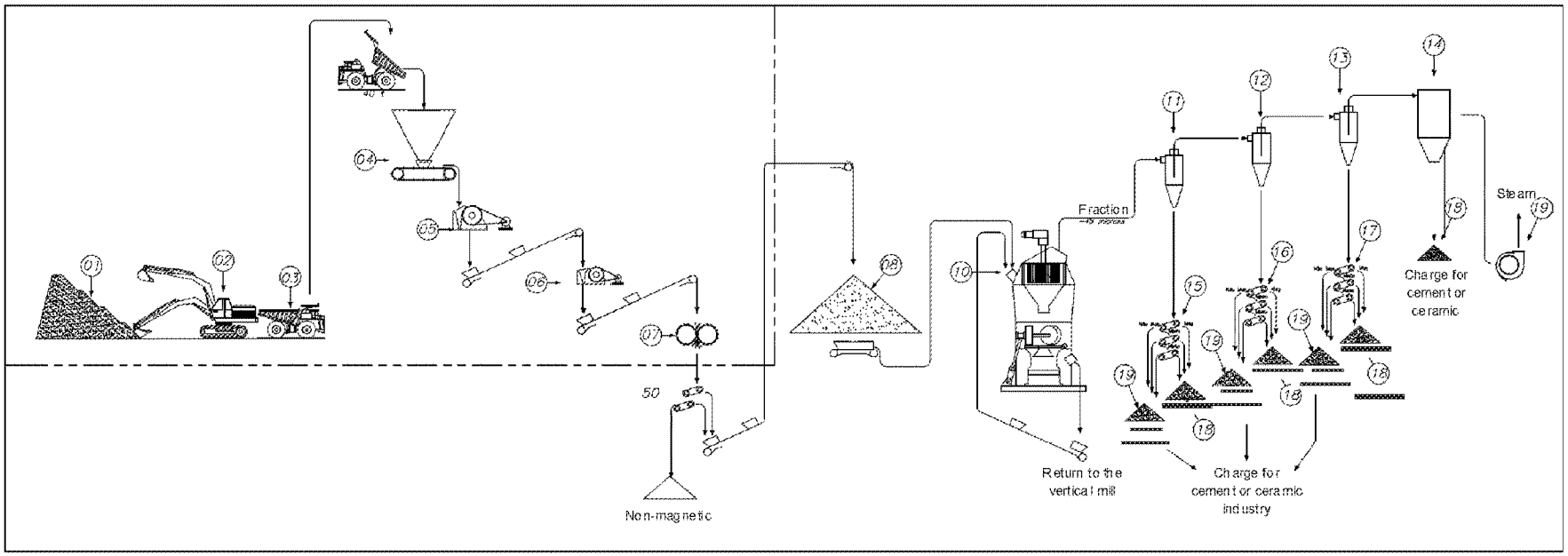
FIGS. 10 illustrates a first type of dry process route according to various embodiments.

In the dry process according to the present invention, FIGS. 10 and/or 11, from the buffer pile 8, the material goes to the vertical mill 10 where grinding occurs. The vertical mill 10 introduced into the system and the process of the present invention is shown in detail in FIG. 3.

Description of the main constituents of the Vertical Mill FIG. 3.

3.1 Ore feed point;

3.2 Mobile track: it is driven by an electric motor and the power is calculated according to production capacity;

3.3 Grinding roll: the vertical mill can be equipped with two or more grinding rollers according to the size and productive capacity; The rolls exert a pressure on the grinding track and the whole ore present in the grinding roller and the grinding track tends to crumble by compression;

3.4 Discharge of coarse fraction: the material was not properly reduced falls by the side of the movable track, which in turn is directed to the discharge point. Then, the material is collected and redirected to the feed point, closing the milling cycle

3.5 The dynamic air classifier comprises a rotor having multiple blades. The larger the number of blades, the finer the granulometric cut, and this is adjusted according to the degree of liberation of each type of compact ore. The air classifier creates a depression inside the mill which is responsible for removal of finely ground particles and discarding the coarse particles repelled by the rotor blades;

3.6 Return of unclassified material: material with coarser particle size rejected by the dynamic air classifier is collected by a cone directing material back to the center of the movable track, joining it to the original material;

3.7 Output of classified material: all the material below the degree of liberation collected by the air classifier is directed to the static classifiers, known as cyclones.

Unitary Step of Milling in a Ball Mill

Currently this type of equipment is widely used in the industry of industrial raw materials such as limestone, feldspar, silica and other industrial minerals, which can be reduced to a particle size that may range from 100 micrometers to 45 micrometers and may reach 20 micrometers. One of the technological innovations of the present invention was to provide this process route in a primary mining process for beneficiation of iron oxide from compact and semi-compact rocks in a dry process.

Figure 4:
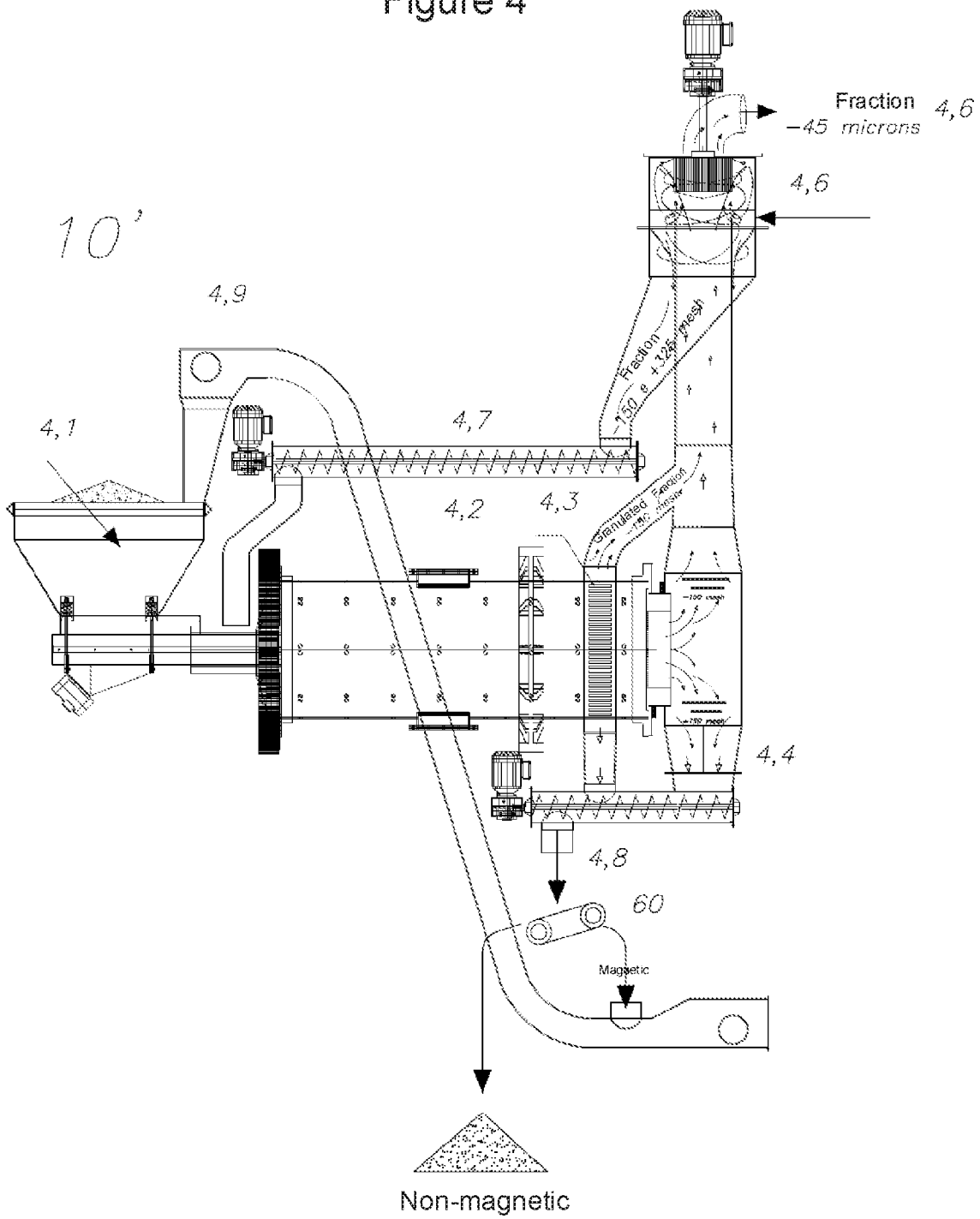
FIG. 4 illustrates the main constituents for milling in a ball mill according to various embodiments.
Figure 14:
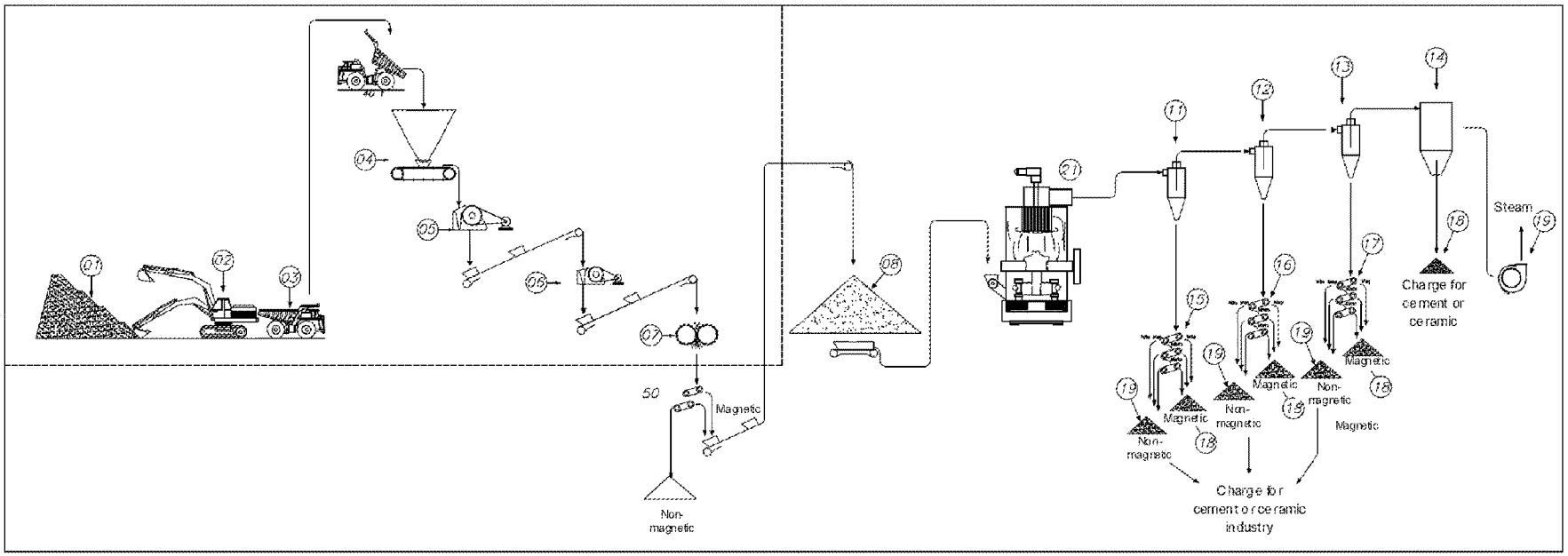
FIG. 14 illustrates a fifth type of dry process route according to various embodiments.
Figure 15:
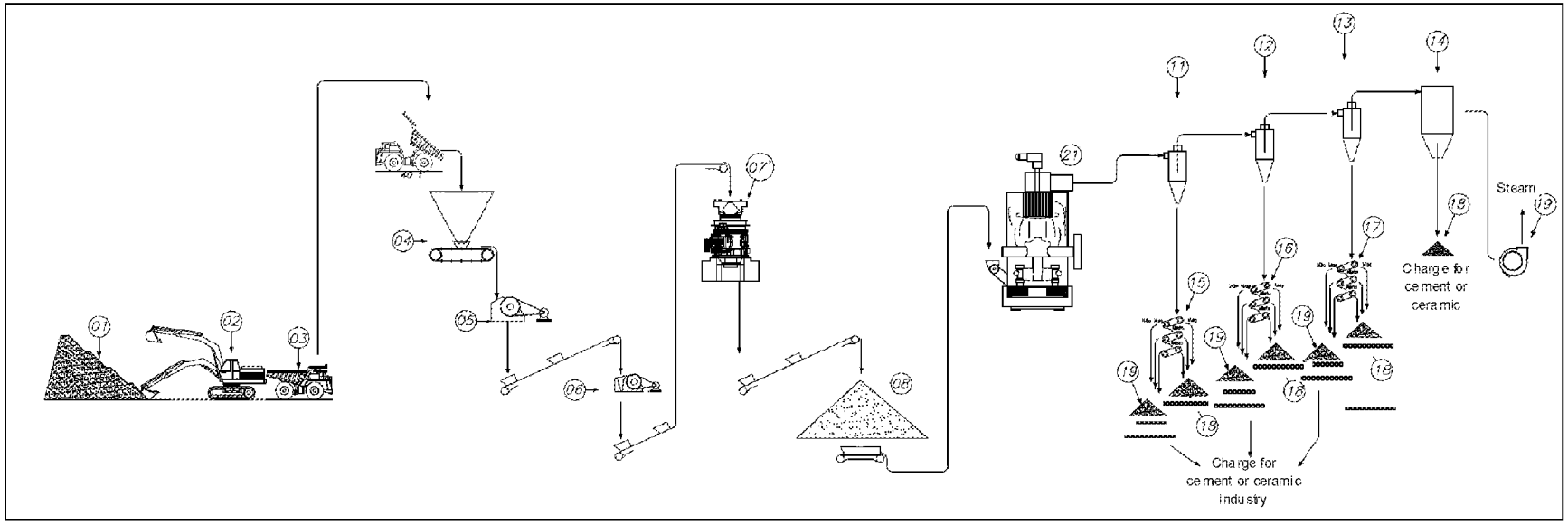
FIG. 15 illustrates a sixth type of dry process route according to various embodiments.

In the dry process according to the present invention, as shown in FIGS. 14 and 15, from the buffer pile 8 the material goes to the ball mill 10' where grinding occurs. The ball mill 10' introduced into the system and the process of the present invention is shown in detail in FIG. 4.

Description of the Main Constituents of the Ball Mill (FIG. 4):

4.1 Ore feed point;

4.2 Mill body with steel balls, properly scaled to the input particle size×the particle size at the end milling;

4.3 Openings in the mill body, to promote the discharge of pre-ground material, a coarser particle size of 4 mm to 0 mm. Fine grains are dragged by the depression created by the dynamic air classifier 4.6 and coarser grains are collected and discharged by a worm thread 4.8;

4.4 The discharge end of the mill is composed of a chapel with two discharge points for coarse and fine fraction.

For a coarse fraction, the material, which was not properly reduced, falls from the bottom of the chapel and is collected by the worm thread 4.8. The fine fraction is channeled through the top of the chapel, which is dragged by the depression created by the dynamic aid classifier 4.6;

4.6. The dynamic air classifier consists of a rotor with several blades; the larger the number of blades, the finer the granulometric cut, and this is adjusted according to the degree of liberation of each type of compact ore. The air classifier creates an inner depression in the mill that is responsible for removal of finely ground particles;

4.7 Return of not classified material. The coarser particle size material, rejected by the dynamic air classifier, is collected by a worm thread driving the material back to the feed point, joining it to the original material;

4.8 Output of classified material. All the material below the degree of liberation collected by the air classifier is directed to the static classifiers, known as cyclones.

Figure 5:
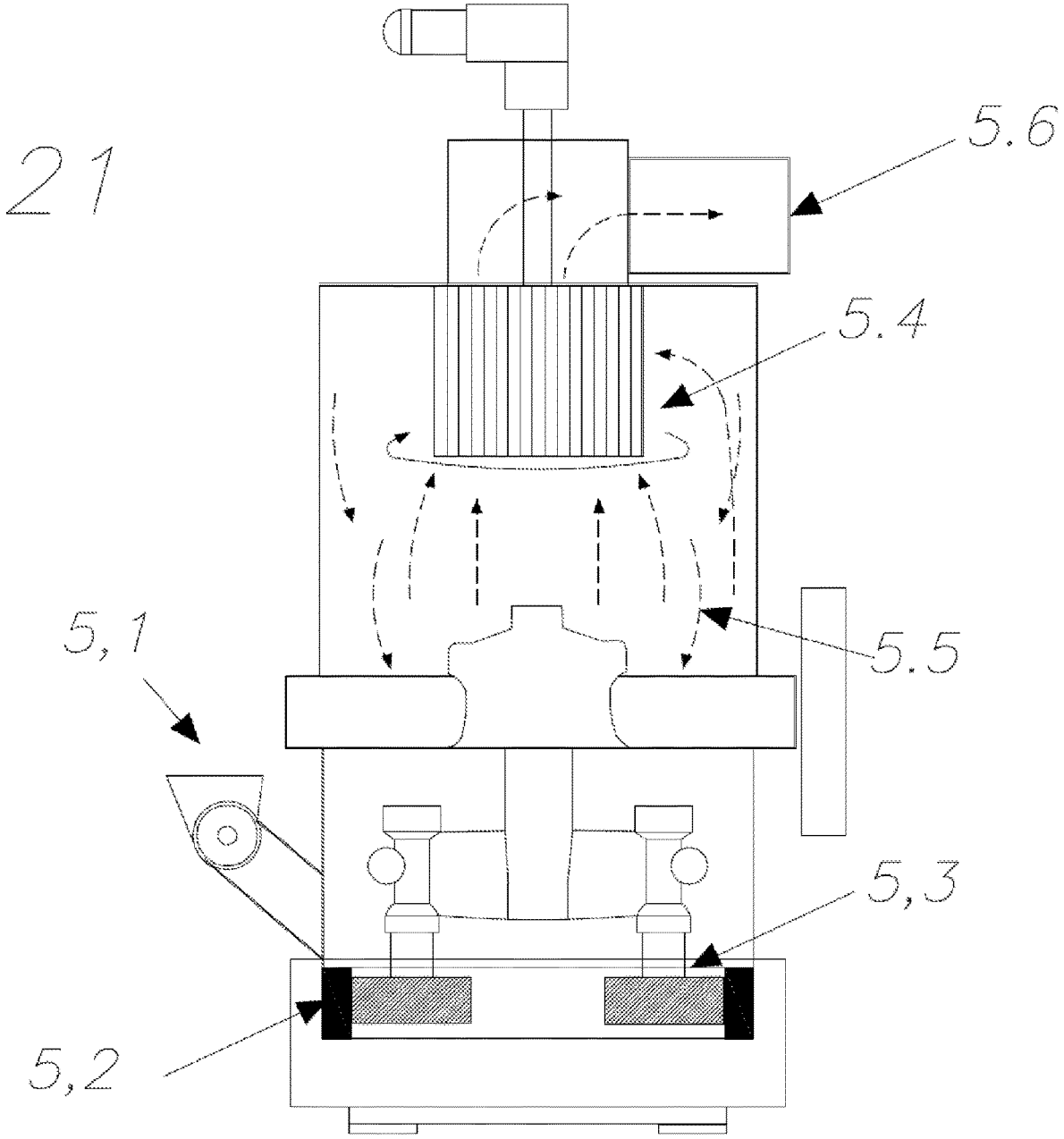
FIG. 5 illustrates the main constituents for milling in a pendulum mill according to various embodiments.

Unitary Step of Milling in a PENDULUM MILL (FIG. 5)

It relates to an equipment with lower production capacity than the vertical mill 10 and ball mill 10', which is also widely used in the industry of industrial raw materials such as limestone, feldspar, silica and other industrial minerals, which can be reduced to a particle size that may range from 100 micrometers to 45 micrometers and may reach 20 micrometers. One of the innovations of the present invention is to combine this process route with the primary mining beneficiation of iron oxide from compact rocks in a dry process.

In the dry process according to the present invention, shown in FIGS. 14 and 15, from the buffer pile 8 the material goes to the pendulum mill 21 where grinding occurs. The pendulum mill 21 introduced into the system and the process of the present invention is shown in detail in FIG. 5, and has the following parts:

Description of the Main Constituents of the Pendulum Mill FIG. 5

5.1 Ore Feed Point;

5.2 Fixed track for distribution of the material fed between the pendulums;

5.3 Rotating pendulums which promote the comminution of the feed material in the fixed track;

5.4 Air classifier that aspirates the comminuted material;

5.5 Returning coarse material, rejected by the air classifier, to the fixed track, along with the original material from the feed point;

5.6 Output of classified material: all the material below the degree of liberation collected by the air classifier is directed to the static classifiers, known as cyclones.

According to the present invention, by means of cyclones, intermediate granulometric cuts are made up to 10 to 5 micrometers and a fine fraction below this cut is retained in the bag filters.

Figure 6:
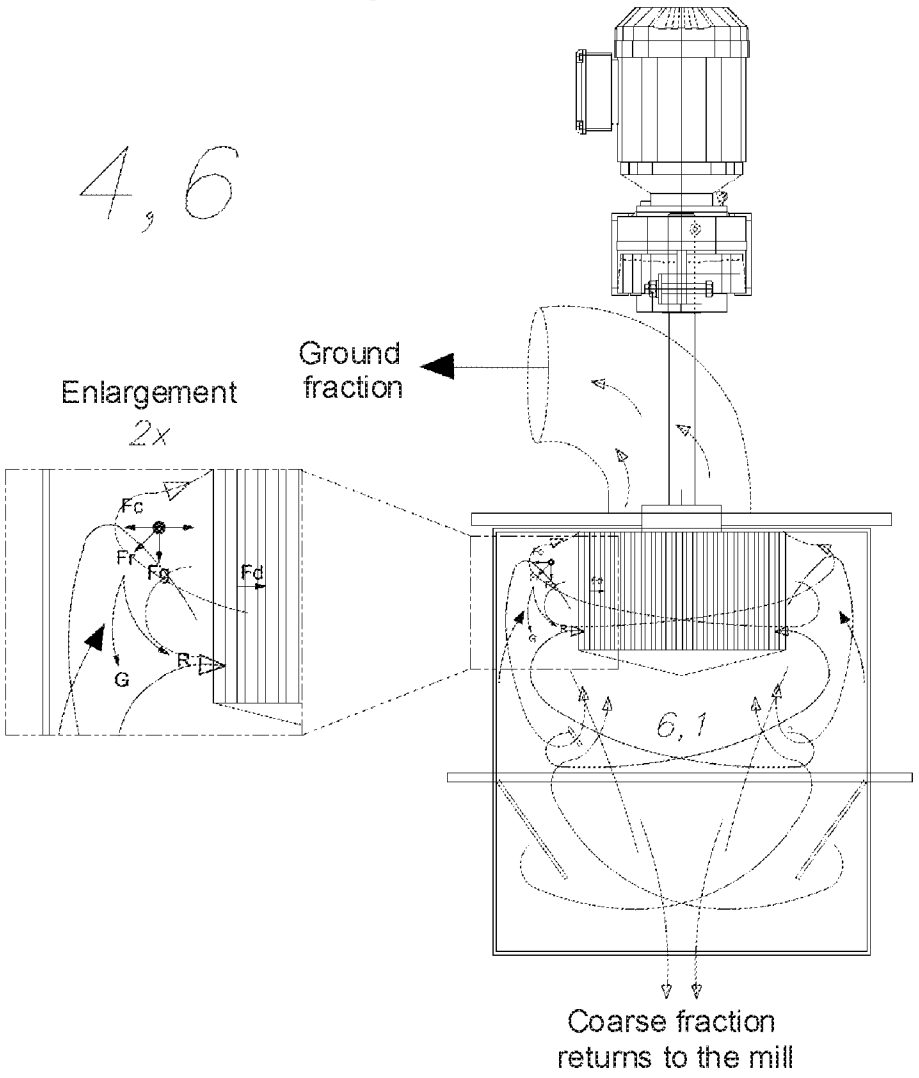
FIG. 6 illustrates direction of grinded fraction of the dynamic air classifier to a first static cyclone according to various embodiments.

The dynamic air classifier 4.6 of FIG. 6 may be coupled to the ball mill 10' output, and may correspond to the dynamic air classifier 3.5 in the vertical mill 10, or to the dynamic air classifier 5.4 in the pendulum mill 21. It creates a depression which drags all particles of different sizes into the rotor 6.1 comprising a series of blades, which aims to disperse the particles to the side of the air classifier. The particles are subjected to three forces: centrifugal force (Fc) driven by the rotor, the air stream produced by the rotor depression (Fd) and gravity (Fg). The resulting (R) refers to when Fc+Fg is smaller than the force of depression (Fd) and corresponds to the fine particles that are dragged into the rotor and the resulting (G) refers to when Fc+Fg is greater than the force of depression (Fd), and corresponds to the coarse particles that are directed downward. As an example, the action of these forces within the dynamic air classifier can be seen in FIG. 6, which shows the Detail of the Depression Forces (Fd), Centrifugal Force (Fc) and Gravity Force (Fg) in which:

$$R(\emptyset\ \text{fine})=Fd>Fg+Fc \text{ and } G\ (\emptyset\ \text{coarse})=Fd<Fg+Fc$$

Thus, after the milling step and air classification, only the fraction with smaller particle size than that of the degree of liberation, consisting of fine particles, i.e., when R (Ø fine) =Fd>Fg+Fc, continues to the other steps of the process.

Comparing the process for granulometric control of dry grinding carried out by an air classifier and the wet grinding process which is carried out by a set of hydrocyclones, the dynamic air classifier is a much simpler unit having lower capex and opex values compared to the process of granulometric and hydrocyclone classification, as indicated in the section describing the prior art. Such air classification promotes the removal of the material ground in degree of liberation, with rejection of the coarse material in the same equipment, which is subjected to one more step of grinding, closing the circuit of grinding and classification of particles by size.

Also in terms of energy consumption, the operation performed by the dry route with air classifiers proves advantageous considering that in a hydrocycloning particle size classification it is necessary to operate with a large amount of water, with a ratio of at least two parts water to one part of ore. In addition, for a good grinding granulometry classification, it is required at least more than one or two additional hydrocycloning steps, which corresponds to reprocessing the fraction "under", so that most fine grains are removed and/or a further hydrocycloning step in the fraction "over", with the purpose of ensuring the granulometric cut. Therefore, considering these additional steps of reprocessing, up to additional parts of water to one part ore are necessary, while in the dry process only the material moves.

Figure 7:
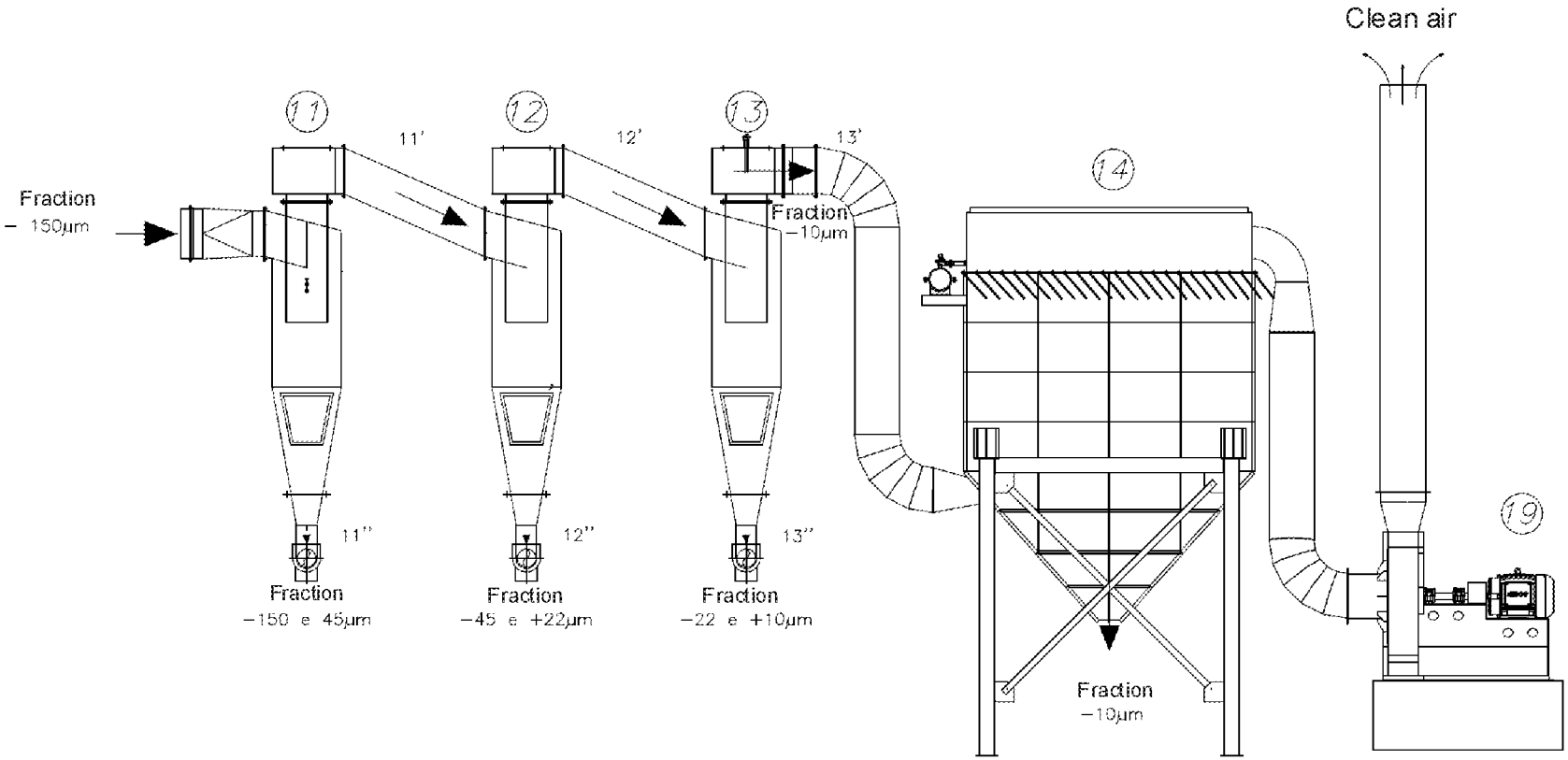
FIG. 7 illustrates a unitary step of static air classification according to various embodiments.

Unitary Step of Static Air Classification FIG. 7

In the step after grinding and classification by the dynamic air classifier, the fraction smaller than the liberation degree, predetermined in the physical/chemical characterization study, shall undergo more three particle size classification steps. The first step having a particle cut-off size at +/−45 μm, the second cut-off at +/−22 μm, which may range between 35 to 18 μm and a third having a particle cut-off size of +/−10 μm, which may range between 15 to 5 μm, that are performed by a set of three static cyclones connected in series with each other (FIG. 7). These cut-off values in micrometers are a mere reference and may vary according to the settings of the exhaustion system.

In FIG. 6, the grinded fraction of the dynamic air classifier is directed to the first static cyclone 11. Said cyclone retains particles that are smaller than the liberation degree, for example, 45 micrometers, which are discharged by the under 11" of the first cyclone. The 30-micrometer fraction comes out by the over 11' of the first cyclone and feeds the second static cyclone 12. The second cyclone retains particles smaller than 30 micrometers and larger than 20 micrometers, which are discharged by the under 12" of the second cyclone. The 20-micrometer fraction comes out by the over 12' of the second cyclone and feeds the third static cyclone 13. The third cyclone retains particles smaller than 20 micrometers and larger than 10 micrometers, which are discharged by the under 13" of the third cyclone. The 10-micrometer fraction comes out by the over 13' of the third cyclone and feeds the set of bag filters 14, which must collect all fraction under 10 μm. The particle size cut-off values refer to orders of magnitude that may vary either up or down according to the exhaust fan 19 speed settings.

The products collected in each of the cyclones 11, 12 and 13 arranged in series can be optionally allocated to the respective cooling columns (not shown), whose purpose is to reduce the temperature which is between 70° C. to 100° C. to a temperature around 40° C. Said cooling is necessary to preserve the magnetic intensity of rare earth magnets (iron-boron-neodymium).

The materials collected in each cyclone (cyclone's under) and that pass though the cooling columns, feed the low and high intensity or high and high intensity magnetic separators with inclined rolls, properly adjusted for each particle size.

A unitary step of magnetic separation, as that described in the claim process of patent BR102014025420-0 (incorporated here for reference) processes all fractions that are smaller than the predetermined particle cut-off size derived from the liberation degree and larger than 10 μm through magnetic separation units.

Based on the possibility of performing tertiary crushing by two means, through HPGR (high pressure grinding rolls) or by means of a cone crusher and final grinding by three different apparatuses, it is possible to establish six different process routes.

The first type of dry process route of the present invention is shown in FIG. 10 and comprises primary crushing using a jaw crusher 5, secondary crushing using a jaw re-crusher 6, tertiary crushing having HPGR 7 (high pressure rolls) and grinding in vertical mill 10.

Thus, the compact ore 1, due to its high resistance for being a rock, is broken up by fire (explosive) and then is removed from the mining, for example, by means of an excavator 2 and laid on the bucket of a truck 3. The truck 3 feeds a silo or hopper 4 and then the material is conveyed to a primary jaw crusher 5 and from there is re-fed to a secondary jaw crusher 6 and the material processed therein goes to a further size reduction step in a HPGR-type roll mill (high pressure rolls) 7, thus reducing the material to a particle size smaller than ¼" (6.4 mm). The fraction smaller than ¼" (feeds magnetic roll separator 50 (235 mm diameter) of high intensity and high yield, thus generating a magnetic product that may or may not be stored in a buffer pile 8; the non-magnetic fraction, substantially free of iron oxide, is intended for use in the construction industry as a filler for concrete and/or for manufacturing cement aggregate, such as blocks and pavers. The material deposited in the pile feeds the vertical mill 10, the grinding occurs through the movement of the mobile track 3.2, compressing the material under the rolls 3.3. The grinding occurs by shearing and because of the conical shape of the rolls it is possible to obtain different grinding levels. The material having the coarsest particle size is removed from the vertical mill and directed again to the feed point 3.1, thus closing the grinding cycle. The ground material is collected by the dynamic air classifier 3.5 located on top of the vertical mill 10. The ground material which has not yet reached the liberation degree returns to the center of the movable track 3.2 to again be ground, and the ground material that has already reached the liberation degree is discharged by the vertical mill 10 and collected by the exhaust system.

The exhaust system comprises three cyclones arranged in series 11, 12 and 13 shown in FIG. 7, wherein the first cyclone 11 collects all material discharged by the vertical mill and classifies them in a particle size of approximately 30 micrometers; the fraction larger than 30 micrometers, named under, is collected in the lower base 11" of the cyclone. The over 11' fraction of the first cyclone 11 feeds the second cyclone 12, duly sized to capture any fraction larger than 20 micrometers and the fraction smaller than 20 micrometers of the second cyclone 12 feeds the third cyclone 13, sized to capture any fraction larger than 10 micrometers, rejecting the fraction smaller than 10 micrometers for the set of bag filters 14. The bag filters 14 have the purpose of retaining all particles which have not been classified or retained in the sets of cyclones. The particle cut-off size values are not specific values and may vary according to each project. It is important to note that said classification in three different particle size diameters is essential for optimum magnetic separation performance for fines.

Figure 11:
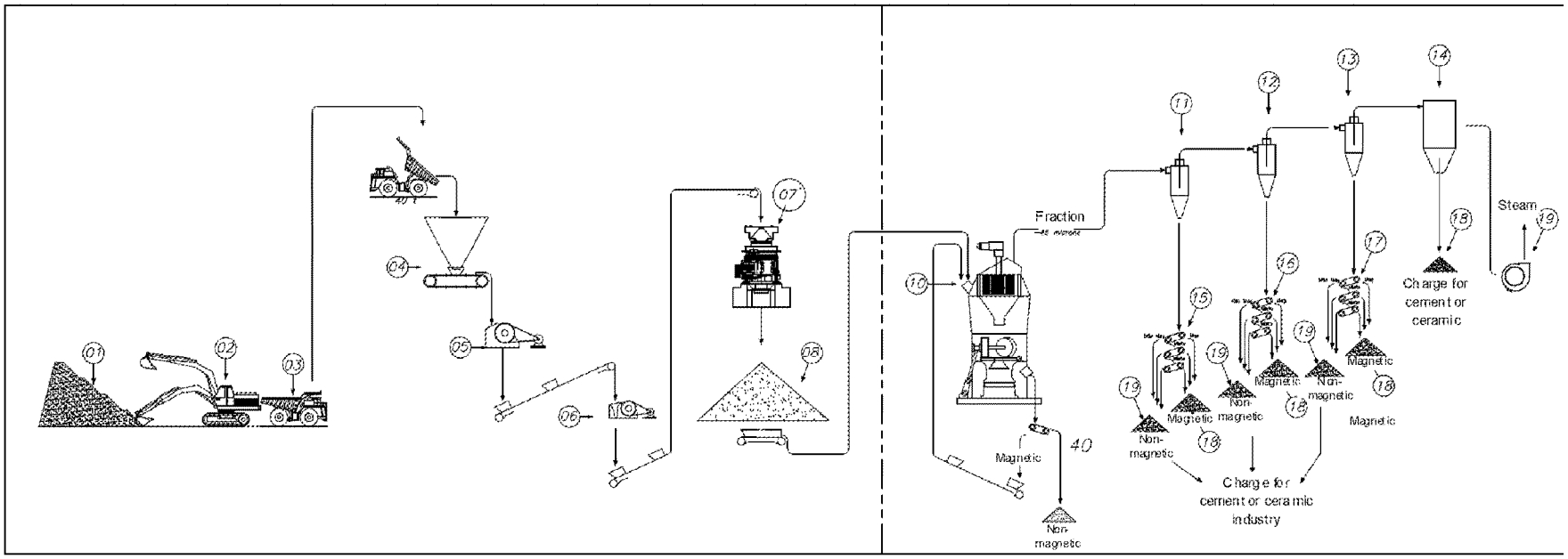
FIG. 11 illustrates a second type of dry process route according to various embodiments.

The first type of dry process route of the present invention is shown in FIG. 11 and comprises primary crushing using a jaw crusher 5, secondary crushing using a jaw re-crusher 6, tertiary crushing having HPGR 7' (high pressure rolls) and grinding in vertical mill 10.

Thus, the compact ore 1, due to its high resistance for being a rock, is broken up by fire (explosive) and then is removed from the mining, for example, by means of an excavator 2 and laid on the bucket of a truck 3. The truck 3 feeds a silo or hopper 4 and then the material is conveyed to a primary jaw crusher 5 and from there is re-fed to a secondary jaw crusher 6 and the material processed therein goes to a further size reduction step in a cone crusher 7', thus reducing the material to a particle size smaller than ¼" (6.4 mm). The material deposited in the pile feeds the vertical mill 10, the grinding occurs through the movement of the mobile track 3.2, compressing the material under the rolls 3.3. The grinding occurs by shearing and because of the conical shape of the rolls it is possible to obtain different grinding levels. The material The non-magnetic fraction, practically free of iron oxide, is intended for use in the construction industry as a filler for concrete and/or for manufacturing cement aggregate, such as blocks and pavers. The magnetic fraction is re-directed to the feed point 3.1, thus closing the grinding cycle. The ground material is collected by the dynamic air classifier 3.5 located on top of the vertical mill 10. The ground material which has not yet reached the liberation degree returns to the center of the movable track 3.2 to again be grounded, and the ground material that has already reached the liberation degree is discharged by the vertical mill 10 and collected by the exhaust system. The ground material that has already reached the liberation degree is discharged by the vertical mill 10 and collected by the exhaust system.

The exhaust system comprises three cyclones arranged in series 11, 12 and 13 shown in FIG. 7, wherein the first cyclone 11 collects all material discharged by the vertical mill and classifies them in a particle size of approximately 30 micrometers; the fraction larger than 30 micrometers, named under, is collected in the lower base 11" of the cyclone. The fraction larger than 30 micrometers, named under, is collected in the lower base 11" of the cyclone. The over 11' fraction of the first cyclone 11 feeds the second cyclone 12, duly sized to capture any fraction larger than 20 micrometers and the fractions smaller than 20 micrometers of the second cyclone 12 feeds the third cyclone 13, optimized to capture any fraction larger than 10 micrometers and reject the fraction smaller than 10 micrometers to the set of bag filters 14. The bag filters 14 have the purpose of retaining all particles which have not been classified or retained in the sets of cyclones. The particle cut-off size values are not specific values and may vary according to each project. It is important to note that said classification in three different particle size diameters is essential for optimum magnetic separation performance for fines.

Figure 12:
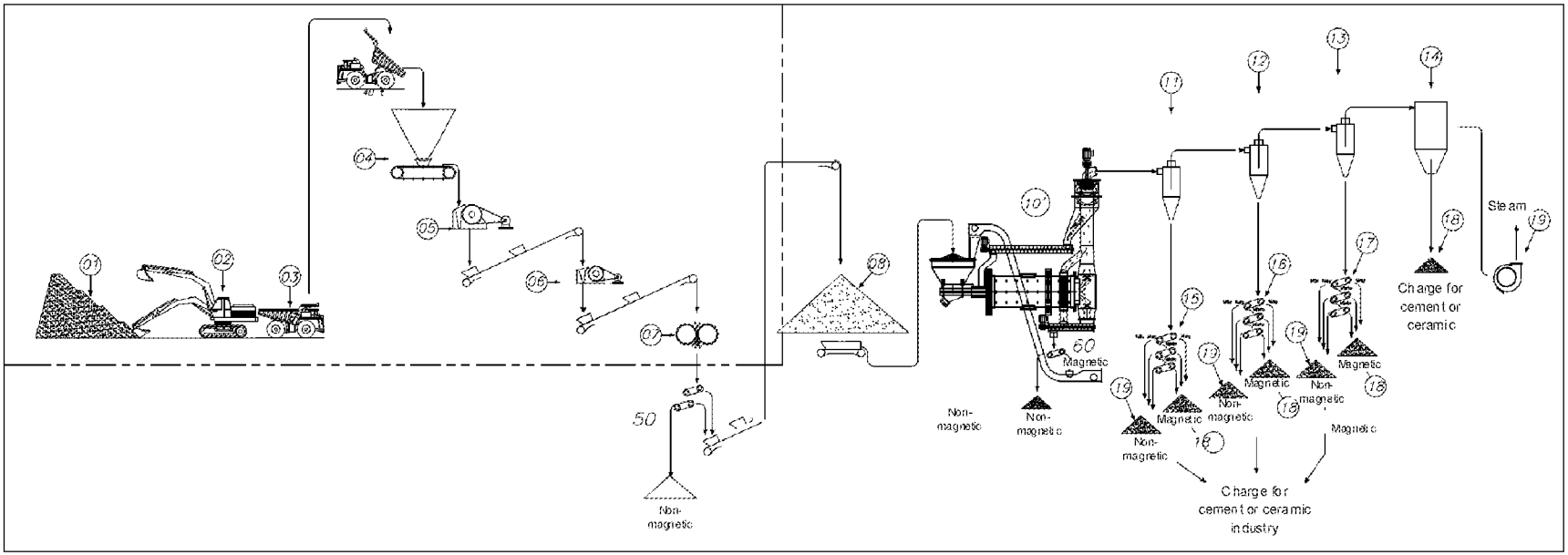
FIG. 12 illustrates a third type of dry process route according to various embodiments.

The first type of dry process route of the present invention is shown in FIG. 12 and comprises primary crushing using a jaw crusher 5, secondary crushing using a jaw re-crusher 6, tertiary crushing having HPGR 7 (high pressure rolls) and grinding in vertical mill 10'.

Thus, the compact ore 1, due to its high resistance for being a rock, is broken up by fire (explosive) and then is extracted/removed from the mining, for example, by means of an excavator 2 and laid on the bucket of a truck 3. The truck 3 feeds a silo or hopper 4 and from there the material is conveyed to a primary jaw crusher 5 and then re-fed to a secondary jaw crusher 6 and the material processed therein goes to a further size reduction step in a HPGR-type (High Pressure Grinding Rolls) roll crusher 7, thus reducing the material to a particle size smaller than ¼" (6.4 mm). The fraction smaller than ¼" feeds magnetic roll separator 50 (235 mm diameter) of high intensity and high yield, thus generating a magnetic product that may or may not be stored in a buffer pile 8. The material deposited on the pile feeds the ball mill 10'. Grinding occurs through the movement of the mill body 4.2, loaded with a load of steel balls that may vary from 35 to 40% of the internal volume. The steel balls form a ripple effect: The particles are subjected to the impact of the balls and the friction with the balls promotes the reduction of the particles. On the upper part of the mill, connected to the discharge hood, an air classifier 4.6 promotes a depression inside the ball mill, dragging the larger and smaller particles out of the mill. The larger particles fall, by gravity, into the lower part 4.4 of the hood. Those, in turn, collected by a worm thread 4.8, feed a magnetic roll separator 60 (diameter 235 mm) of high intensity and high yield, generating a magnetic product that may or may not be stored in a buffer pile and redirected to the ball mill feed 4.1. The non-magnetic fraction, practically free of iron oxide, is intended for use in the construction industry as a filler for concrete and/or for manufacturing cement aggregate, such as blocks and pavers. On the upper part of the discharge hood, fines are dragged to the rotor of the dynamic air classifier 4.6, which in turn classifies the material ground in the liberation degree. The material larger than the liberation degree is directed out of the dynamic air classifier 4.6 and collected by a worm thread 4.7, which re-directs it to the feed point 4.1. The material ground smaller than the liberation degree is thrown out of the air-classifying mill 4.6 and captured by the exhaust system.

The exhaust system consists of three cyclones arranged in series 11, 12 and 13 shown in FIG. 7, wherein the first cyclone 11 collects all material discharged by the ball mill 10' and classifies them in a particle size of approximately 30 micrometers. The fraction larger than 30 micrometers, named under, is collected in the lower base 11" of the cyclone. The fraction over 11' of the first cyclone 11 feeds the second cyclone 12, duly sized to capture any fraction larger than 20 micrometers, and the fraction smaller than 20 micrometers of the second cyclone 12 feeds the third cyclone 13, sized to capture any fraction larger than 10 micrometers and rejecting the fraction smaller than 10 micrometers to the set of bag filters 14. The bag filters 14 have the purpose of retaining all particles which have not been classified or retained in the sets of cyclones. The particle cut-off size values are not specific values and may vary according to each project. It is important to note that said classification in three different particle size diameters is essential for optimum magnetic separation performance for fines.

Figure 13:
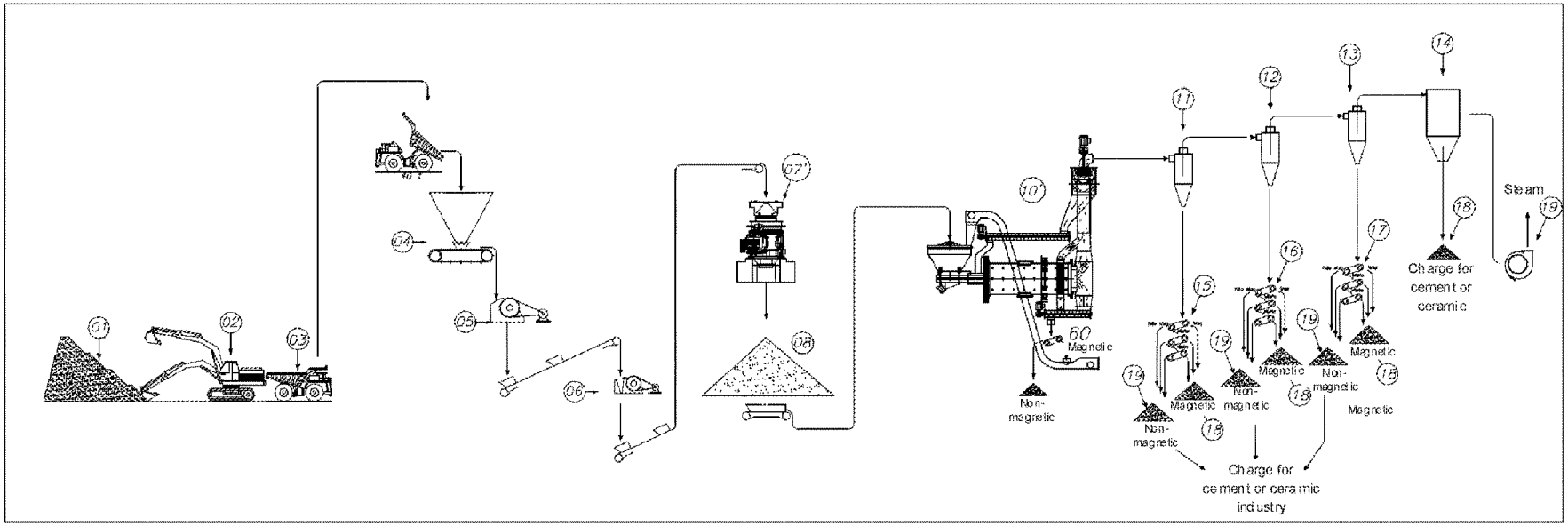
FIG. 13 illustrates a fourth type of dry process route according to various embodiments.

The fourth type of dry process route of the present invention, shown in FIG. 13, comprises primary crushing using a jaw crusher 5, secondary crushing using a jaw re-crusher 6 and tertiary crushing using a cone crusher 7', and grinding in a ball mill 10'.

The compact ore 1, due to its high resistance for being a rock, is broken up by fire (explosive). Subsequently, it is extracted/removed from the mining, for example, by means of an excavator 2 and laid on the bucket of a truck 3. The truck 3 feeds a silo or hopper 4 and from there the material is conveyed to a primary jaw crusher 5 and then is re-fed to a secondary jaw crusher 6 and the material processed therein goes to a further size reduction step in a cone crusher 7', thus reducing the material to a particle size smaller than ¼" (6.4 mm). The material deposited in the buffer pile 8 feeds the ball mill 10'. The grinding occurs through the movement of the mill body 4.2, loaded with a load of steel balls that may vary from 35 to 40% of the internal volume. The steel balls form a ripple effect: the particles are impacted by the falling balls and the ball-on-ball friction promotes the reduction of the particles. On the upper part of the mill, connected to the discharge hood of the mill, an air classifier 4.6 promotes a depression inside the ball mill, dragging the larger and smaller particles out of the mill, the larger particles falling, by gravity, into the lower part 4.4 of the hood, and being in turn collected by a worm thread 4.8, that feeds a magnetic roll separator 60 (235 mm diameter) of high intensity and high yield, and are re-directed to the feed 4.1 of the ball mill 10'. The non-magnetic fraction, practically free of iron oxide, is intended for use in the civil construction industry as a filler for concrete and/or for manufacturing cement aggregates, such as blocks and pavers. On the upper part of the discharge hood, the fines are dragged to the rotor of the dynamic air classifier 4.6, which in turn classifies the materials ground in the liberation degree. The material larger than the liberation degree is directed out of the dynamic air classifier, collected by a worm thread 4.7 and re-directed to the feed point 4.1. The material ground smaller than the liberation degree is thrown out of the air classifier 4.6 and collected by the exhaust system.

The exhaust system consists of three cyclones in series 11, 12 and 13 shown in FIG. 7, wherein the first cyclone 11 captures all the material released by the ball mill 10' and classifies into a grain size of approximately 30 micrometers. The fraction greater than 30 micrometers called under is collected at the bottom base 11" of the cyclone. The over fraction 11' of the first cyclone 11 feeds the second cyclone 12, properly sized to capture any fraction greater than 20 micrometers and the fraction below 20 micrometers of the second cyclone 12 feeds the third cyclone 13, sized to capture all the fraction larger than 10 micrometers rejecting the fraction smaller than 10 micrometers for all of sleeve filters 14. The sleeve filters 14 are intended to retain all particles which were not classified or retained in the cyclone assemblies. The values of granulometric cuts are not specific values and may vary according to each project. It is important to stress that this classification into three different particle size diameters is essential for optimum performance of magnetic separation for the fines.

The fifth embodiment of the dry process route according to the present invention, shown in FIG. 14 is formed by primary crushing performed by means of jaw crusher 5, secondary crushing by jaw re-crusher 6, and tertiary crushing with HPGR 7 (High Pressure Grinding Roller) and grinding in a pendulum mill 21.

Compact ore 1, due to its high resistance for being a rock, is dismantled by means of fire (blasting). It is then extracted/removed from the mining, for example by means of an excavator 2 and arranged in the back of a truck 3. The truck 3 feeds a silo or a hopper 4 and is then taken to a primary jaw crusher 5 and this, then, feeds a secondary re-crusher jaw 6 and material processed therein moves to a further size reduction step, in a HPGR-type roll crusher 7 (high pressure rollers) 7, thus reducing the material to a particle size of ¼" (6.4 mm). The fraction lower than ¼" feeds a high intensity and high productivity magnetic separator roller 50 (diameter of 235 mm), generating a magnetic product that may or may not be deposited in a buffer pile 8. The non-magnetic fraction, practically free from oxide iron, is intended for application in the construction industry, as a filler for concrete and/or cement aggregate production, as for example, blocks and pavers. The material deposited on the stack feeds the pendulum mill 21. Grinding is performed by moving pendulums 5.3 with the fixed track 5.2, grinding being performed, therefore, by shearing. The ground material is captured by the dynamic air classifier 5.4 arranged at the upper portion of pendulum mill 21. The ground material that has not yet reached the liberation degree returns to the grinding zone in order to be ground again. The ground material that has already reached the liberation degree is thrown out of the pendulum mill and picked up by the exhaust system.

The exhaust system consists of three cyclones in series 11, 12 and 13 shown in FIG. 7, wherein the first cyclone 11 captures all the material released by the vertical mill and classifies into a grain size of approximately 30 micrometers. The fraction greater than 30 micrometers called under is collected at the bottom base 11" of the cyclone. The over fraction 11' of the first cyclone 11 feeds the second cyclone 12, properly sized to capture any fraction greater than 20 micrometers and the fraction below 20 micrometers of the second cyclone 12 feeds the third cyclone 13, sized to capture all the fraction larger than 10 micrometers rejecting the fraction smaller than 10 micrometers for all of sleeve filters 14. The sleeve filters 14 are intended to retain all particles which were not classified or retained in the cyclone assemblies. The values of granulometric cuts are not specific values and may vary according to each project. It is important to stress that this classification into three different particle size diameters is essential for optimum performance of magnetic separation for the fines.

The sixth embodiment of the dry process route according to the present invention, shown in FIG. 15 is formed by primary crushing performed by means of jaw crusher 5, secondary crushing by jaw re-crusher 6, and tertiary crushing with cone crusher 7' and grinding in a pendulum mill 21.

Compact ore 1, due to its high resistance for being a rock, is dismantled by means of fire (blasting). It is then extracted/removed from the extraction site, for example by means of an excavator 2 and arranged in the back of a truck 3. The truck 3 feeds a silo or a hopper 4 and is then taken to a primary jaw crusher 5 and this, then, feeds a secondary re-crusher jaw 6 and material processed therein moves to a further size reduction step in a cone crusher 7', thus reducing the material to a particle size lower than ¼" (6.4 mm). The material deposited on the stack feeds the pendulum mill 21. Grinding is performed by moving pendulums 5.3 with the fixed track 5.2, grinding being performed, therefore, by shearing. Because of the rounded shape of pendulums 5.3, it is possible to obtain different grinding levels. The ground material is captured by the dynamic air classifier 5.4 arranged at the upper portion of pendulum mill 21. The ground material that has not reached the liberation degree yet returns to the grinding zone in order to be ground again. The ground material that has already reached the liberation degree is thrown out of the pendulum mill and picked up by the exhaust system.

The exhaust system consists of three cyclones in series 11, 12 and 13 shown in FIG. 7, wherein the first cyclone 11 captures all the material released by the vertical mill and classifies into a grain size of approximately 30 micrometers. The fraction greater than 30 micrometers called under is collected at the bottom base 11" of the cyclone. The over fraction 11' of the first cyclone 11 feeds the second cyclone 12, properly sized to capture any fraction greater than 20 micrometers, and the fraction below 20 micrometers of the second cyclone 12 feeds the third cyclone 13, sized to capture all the fraction larger than 10 micrometers rejecting the fraction smaller than 10 micrometers for all of sleeve filters 14. The sleeve filters 14 are intended to retain all particles which were not classified or retained in the cyclone assemblies. The values of granulometric cuts are not specific values and may vary according to each project. It is important to stress that this classification into three different particle size diameters is essential for optimum performance of separation.

Figure 8:
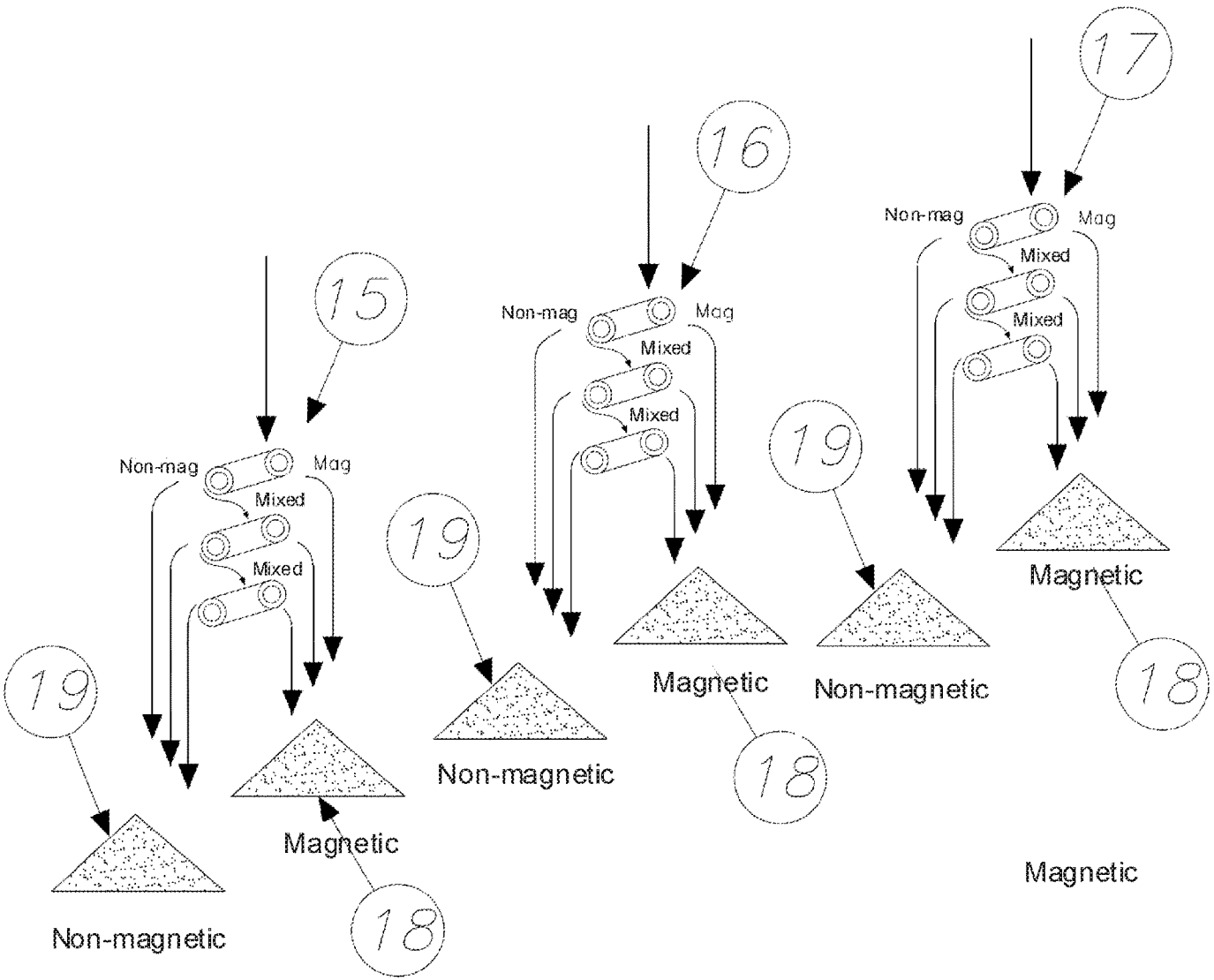
FIG. 8 illustrates a magnetic separation unit according to various embodiments.

Provided in the magnetic separation unit shown in FIG. 8 are magnetic separation means provided with two to four magnetic rollers arranged in cascade development, formed by low intensity (iron-boron) and/or high magnetic intensity (Rare earths) magnets, wherein the magnetic rollers are arranged in a variable tilt angle between 5° and 55°.

Figure 9:
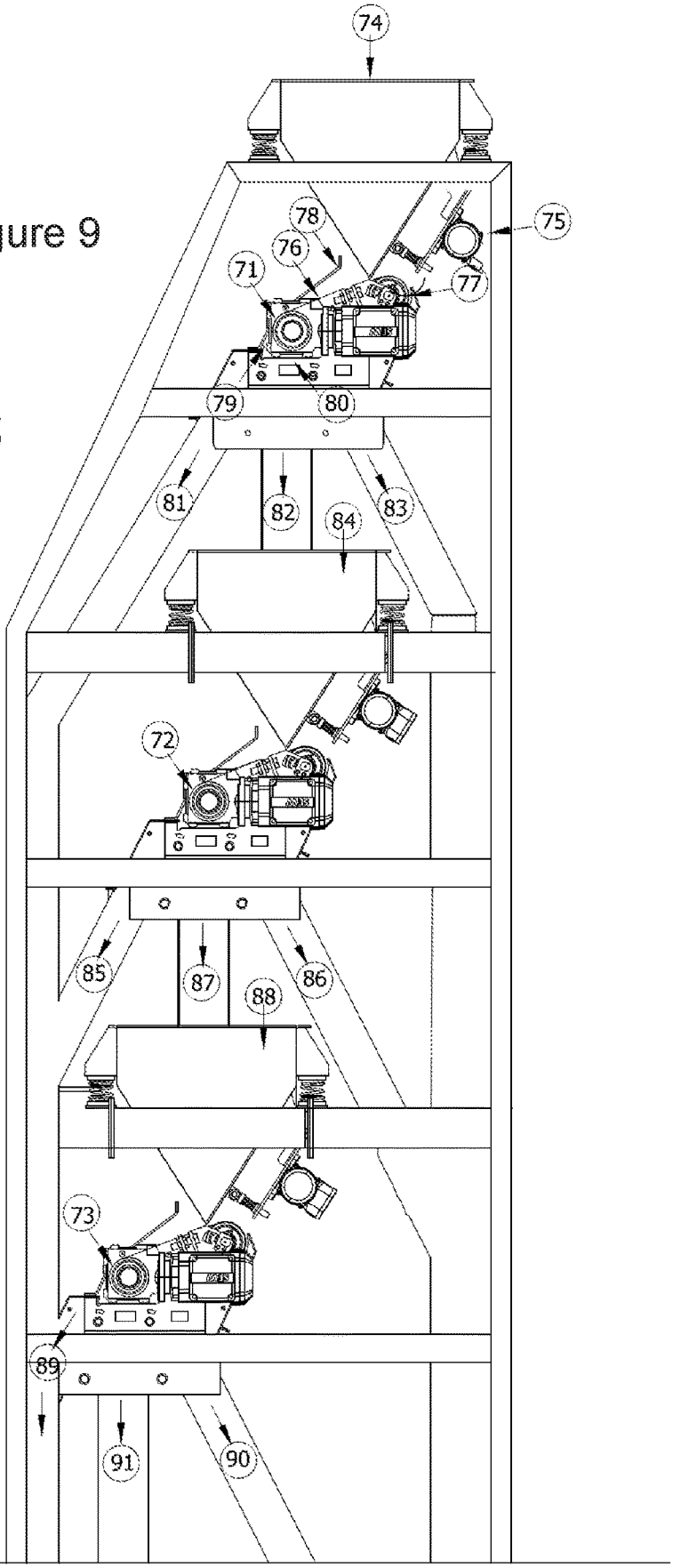
FIG. 9 illustrates a magnetic separation scheme according to various embodiments.

FIG. 09 shows the magnetic separation scheme with three rollers in cascade development. In the first magnetic separation unit 15, the material from the first cyclone 11 feeds a first magnetic roller 71, which can be low or high intensity, generating a first non-magnetic fraction, which will be immediately discarded; a first magnetic fraction consisting of a final product with a content above 64% of Fe(T), and a first mixed fraction which feeds a second high intensity magnetic roller. In the same sequence, the second magnetic roller 72 generates a second non-magnetic fraction, which also is discarded, and a second magnetic fraction with a content above 64% of Fe(T), besides a second mixed fraction which feeds the third magnetic roller. In turn, the third magnetic roller 73 generates a third non-magnetic fraction which is also discarded, a third magnetic fraction with a content above 64% of Fe(T) and a third mixed fraction which is discarded along with the third non-magnetic fraction.

Thus, successively, the product of the second cyclone 12 will feed a cooling column and, then, the second magnetic separation unit 16, in the same sequence, as in the first magnetic separation unit, feeds the first magnetic roller, which can be of low or high intensity, generating a first non-magnetic fraction, which must be immediately discarded; a first magnetic fraction consisting of a final product with a content above 64% of Fe(T), and a first mixed fraction which feeds a second high intensity magnetic roller. In the same sequence, the second magnetic roller generates a second non-magnetic fraction, which is also discarded, and a second magnetic fraction with a content above 64% of Fe(T), besides a second mixed fraction which will feed the third magnetic roller. In turn, the third magnetic roller generates a third non-magnetic fraction which is also discarded, a third magnetic fraction with a content above 64% of Fe(T) and a third mixed fraction which is discarded along with the third non-magnetic fraction. The same will occur in the third magnetic separation unit 17.

FIG. 09 also shows the magnetic separation scheme with three rollers in cascade development, wherein the first magnetic roller 71 can be of low intensity or high intensity. Depending on the characteristics of the material to be separated, the use of a low intensity magnetic roller may be preferred in view of the fact that the permanent magnets are made from iron-boron, with variable magnetic intensity between 500 and 3000 Gauss, and is, therefore, intended for separation of high magnetic susceptibility minerals (e.g. magnetite—FeOFe2O3). In turn, in the case of the high-intensity magnetic rollers, the permanent magnets are made of iron-boron-neodymium, with magnetic intensities ranging between 7,500 and 13,000 G, for separation of low magnetic susceptibility minerals (such as hematite and iron-limonite hydroxides).

FIG. 9, which consists of a representation of a side section of the magnetic separation unit, illustrates in detail all the elements of the magnetic separation unit in cascade development, which in the case illustrated, has three rollers, one superimposed on the other. As already seen, each of the cyclones, with their properly classified particle sizes, feeds a respective set of magnetic separators. According to FIG. 9, the set consists of a receiver silo 74, wherein the power to the set can alternatively be controlled by the intensity of vibration by means of a pneumatic vibrator 75. However, preferably, silo 74 configured with tilt angles which provide a better flowability of the material to the set of magnetic separators.

Then, the material is discharged to a PU-coated polyester belt 76; the belt is tensioned by a first low intensity ferrite magnet (iron-boron) magnetic roller 71 and by a support roller 77.

The magnetic separation is controlled by the variation of the magnetic roller speed and by the positioning of the splits. To contain the dissipation of dust and direct the material to the magnetic roller 71 an acrylic plate 78 is positioned adjacent to belt 76. A split 79 separates the non-magnetic fraction from the mixed fraction and a split 80 separates the mixed fraction from the magnetic fraction. The first non-magnetic fraction is collected by chute 81, the first mixed fraction is collected by chute 82 and the first magnetic fraction is collected by chute 83. The first mixed fraction chute 82 feeds silo 84 of the second high intensity rare earth magnet (neodymium-iron-boron) magnetic roller 72. The second high intensity rare earth magnet (iron-boron-neodymium) magnetic roller 72, after the magnetic separation, creates a second non-magnetic fraction, which is discarded through chute 85, the second magnetic fraction is discarded in chute 86 and a second mixed fraction is directed to chute 87 which feeds the third high intensity rare earth magnet (neodymium-iron-boron) magnetic roller 73 through silo 88. third high intensity rare earth magnet (neodymium-iron-boron) magnetic roller 73, after the magnetic separation, generates a third non-magnetic fraction which will be discarded through chute 89, a third magnetic fraction which will be discarded into chute 90 and a 3rd mixed fraction, which through chute 91, is discharged along with the other non-magnetic fractions. Item 77 in the three magnetic separation units comprise support rollers for the PU-coated polyester belt 76.

The low and high intensity magnetic rollers are tilted, wherein the tilt angle may range from 5° to 55°, with an ideal work range of 15° to 25°, wherein the tilt is defined in terms of particle size release of the oxide iron. This tilt, according to the tests already carried out, increases the separation efficiency of the magnetic fraction from the non-magnetic fraction.

Although the present invention has been described with respect to its particular characteristics, it is clear that numerous other forms and modifications of the invention will be obvious to those skilled in the art.

Obviously, the intention is not limited to the embodiments shown in the figures and disclosed in the above description, so that it may be modified within the scope of the appended claims.

The invention claimed is:

1. A system for dry recovery of iron oxide fines from iron-bearing compact and semi-compact rocks, the system comprising:

(a) primary, secondary and tertiary crushing means for preliminarily reducing a granulometry of ores containing iron oxide fines in compact and semi-compact rocks;

(b) means for finely grinding iron oxide minerals reduced through primary, secondary and tertiary crushing, provided with a dynamic air classifier;

(c) means of static air classification arranged in series for intermediate granulometric cuts and bag filters for retaining fine fraction;

(d) means of magnetic separation of low and high magnetic intensity in each granulometric range classified by means of static air classification;

wherein the means of magnetic separation are two to four magnetic rolls formed by at least one of low or high magnetic intensity rare earth magnets, wherein the two to four magnetic rolls are arranged in a cascade relative to one another and each oriented at a variable tilt angle of between 5° and 55°;

(e) means of disposal of a non-magnetic fraction in each means of magnetic separation and collection of a first magnetic fraction consisting of final product; and (f) means for driving a discharged, mixed fraction in each means of magnetic separation for processing in following means of magnetic separation.

2. The system according to claim 1, wherein:

each of the means of static air classification is connected with an inlet of a respective column cooling unit, and an outlet the respective column cooling unit is connected with the means of magnetic separation.

3. The system according to claim 2, wherein the primary crushing means consists of a first jaw crusher, the second crushing means consists of a second jaw crusher, and the tertiary crushing means is either a high-pressure grinding roll (HPGR) or a cone crusher.

4. The system according to claim 3, wherein the dynamic air classifier is arranged at an upper part of the means of fine grinding and configured for removal of the finely ground particles.

5. The system according to claim 4, wherein the means of static air classification comprises static cyclones.

6. The system according to claim 5, wherein the means of fine grinding is one of a vertical mill, a ball mill, or a pendulum mill.

7. The system according claim 3, wherein the means of static air classification comprises static cyclones.

8. The system according to claim 2, wherein the dynamic air classifier is arranged at an upper part of the means of fine grinding and configured for removal of the finely ground particles.

9. The system according claim 8, wherein the means of static air classification comprises static cyclones.

10. The system according to claim 2, wherein the means of static air classification comprises static cyclones.

11. The system according to claim 1, wherein the primary crushing means consists of a first jaw crusher, the second crushing means consists of a second jaw crusher, and the tertiary crushing means is either a high-pressure grinding roll (HPGR) or a cone crusher.

12. The system according to claim 11, wherein the dynamic air classifier is arranged at an upper part of the means of fine grinding and configured for removal of the finely ground particles.

13. The system according claim 12, wherein the means of static air classification comprises static cyclones.

14. The system according to claim 11, wherein the means of static air classification comprises static cyclones.

15. The system according to claim 1, wherein the means of fine grinding is one of a vertical mill, a ball mill, or a pendulum mill.

16. The system according to claim 1, wherein the dynamic air classifier is arranged at an upper part of the means of fine grinding and configured for removal of the finely ground particles.

17. The system according claim 16, wherein the means of static air classification comprises static cyclones.

18. The system according to claim 1, wherein the means of static air classification comprises static cyclones.

* * * * *